United States Patent [19]

Rasmussen et al.

[11] 4,064,649

[45] Dec. 27, 1977

[54] WINDOW, PARTICULARLY INTENDED FOR INSTALLATION IN AN INCLINED OR FLAT ROOF

[75] Inventors: Villum Benedikt Kann Rasmussen, Klampenborg; Lars Erik Kann-Rasmussen, Holte, both of Denmark

[73] Assignee: V. Kann Rasmussen & Co., Soborg, Denmark

[21] Appl. No.: 745,696

[22] Filed: Nov. 29, 1976

Related U.S. Application Data

[63] Continuation of Ser. No. 583,207, June 3, 1975, abandoned.

[51] Int. Cl.[2] ..... E05D 15/30; E05D 15/42; E05D 15/44

[52] U.S. Cl. ..... 49/250

[58] Field of Search ..... 49/246, 250–252, 49/216–218, 324, 357

[56] References Cited

U.S. PATENT DOCUMENTS

| | | | |
|---|---|---|---|
| 1,172,550 | 2/1916 | Oberer | 49/246 |
| 2,015,305 | 9/1935 | Grayson | 49/250 X |
| 2,105,873 | 1/1938 | Weinheimer | 49/250 X |
| 2,108,289 | 2/1938 | Laddon | 49/250 X |
| 3,513,799 | 5/1970 | Beas | 49/250 X |

FOREIGN PATENT DOCUMENTS

| | | | |
|---|---|---|---|
| 842,455 | 3/1939 | France | 49/246 |
| 10,652 | 12/1906 | United Kingdom | 49/246 |

*Primary Examiner*—Kenneth Downey
*Attorney, Agent, or Firm*—Lane, Aitken, Dunner & Ziems

[57] ABSTRACT

In a window comprising a stationary frame and a movable sash, the sash is tiltable on an axis that during the opening motion of the sash is displaceable away from the frame substantially parallel to the plane thereof.

4 Claims, 2 Drawing Figures

WINDOW, PARTICULARLY INTENDED FOR INSTALLATION IN AN INCLINED OR FLAT ROOF

This is a continuation, of application Ser. No. 583,207 filed June 3, 1975, abandoned.

BACKGROUND OF THE INVENTION

This invention relates to a window particularly intended for installation in an inclined or flat roof. More particularly, this invention relates to a window comprising a movable sash and a stationary frame wherein the sash is displaceable during the opening motion away from the frame substantially parallel to the plane thereof.

During the last decades, skylights or overhead windows of the tilting type have been used to an increasing extent, the said windows providing a favourable distribution of light in the room and a good insulation against heat losses as well as the possibility of an easy cleaning of the outside of the window pane, since the sash can be tilted so that its outside faces the room. On the other hand, such tilting windows may entail sealing problems for the very reason that the sash should be capable of being tilted and consequently cannot simply rest on the outside of the frame in its closed position. External cover rails are therefore required on the frame and sash elements or possibly movable sealing and locking rails between these window elements, which makes the manufacture of the window essentially more expensive and may cause trouble at the opening and closing of the window, for example on account of accumulated dirt. Another drawback of ordinary tilting windows is that in its more or less open position the sash obstructs the view and prevents the aperture surrounded by the frame from being used as an emergency exit.

These drawbacks have to some extent been eliminated in a skylight which is known from the specification of Swedish patent No. 312,500 and in which a central region of the sash is journalled in a pair of parallel arms which are in turn journalled at one side of the frame, while at the same time the opposite sash element is pivotally and displaceably connected to the frame so that it can be moved in the direction towards the said frame side during the opening of the window. In this case, the sash can in its closed position rest on the outside of the frame which results in a simplification of the sealing problem, and from this position the sash can be opened by being tilted and displaced into a position in which it is at right angles to the plane of the frame in the vicinity of the said frame side, so that a comparatively large emergency exit aperture is provided. In the case of this window, the sash will, however, in virtually any open position obstruct the view considerably, and in fact the window is first and foremost intended for being mounted in an approximately flat roof, e.g. covering a staircase.

SUMMARY OF THE INVENTION

With its starting point in this prior art technique the invention relates to a window with a frame, which is particularly intended for being mounted in an inclined or flat roof, and a sash which at one sash element is provided with a hinge connection, which is displaceable substantially parallel to the plane of the frame, and where the sash is moreover guided by at least one link inserted between the frame and the sash, and the window according to the invention differs from the prior art construction mentioned last in that after the commencing opening of the sash the hinge connection is displaceable in the direction away from the journalling means of link in the frame.

Such a window is well suited for being mounted or installed in a more or less inclined position in living rooms and may be considerably simpler of construction than the above-mentioned skylights of the tilting type intended for the same purpose, particularly because uniform sections may be used at all of the four sides in frame and sash, respectively. At the same time, the sealing problem may be very effectively coped with since the sash along its full circumference may have a skirt which in the closed position encloses the frame and possibly extends right down to the surface of the roof around the frame. Upon commencing opening of the window, the sash will by being turned in the hinge connection be eased from the frame without this operation causing any wear worth mentioning on packings, if any, in the window, and when the sash has been eased so much that the skirt on the sash element located opposite to the hinge connection has been raised clear of the associated frame element, the sash can without being impeded be given a movement, determined by the link guiding and the displaceable hinge connection, toward an open final position in which it is located completely outside the aperture of the frame or covers only a small part of the said aperture. In this final position, the outside of the sash still faces outwardly (in contradistinction to what is the case in ordinary top-hinged windows), and an external cleaning of the window pane is therefore possible from inside the room.

According to the invention, it is preferred that the link or at least one of the links is at its bearing in the frame connected to an internal manoeuvring arm for the sash. This manoeuvring arm is easily accessible for operation with a view to the opening and closing of the sash and when suitably dimensioned, offers a good control of the sash.

When the window comprises two parallel links, each of which is connected to an internal manoeuvring arm, the two manoeuvring arms may expediently be interconnected by means of a grip rod or handle rail. This rod will have a stabilizing effect on the link connection between frame and sash and will be convenient for a two-hand grip which may be necessary in the case of relatively large and consequently heavy window sashes. The lengths of the links and the manoeuvring arms may be so adapted that, in the closed position of the window, the grip rod is placed along the frame element at the hinge connection and, in the open position, lies along the opposite frame element, so that in both cases it will be more or less concealed. In either of these positions the grip rod may, if it be desired, be fixed in a suitable way, e.g. by means of a spring hook, with a view to securing the sash in the particular position.

According to the invention, it is preferred that the links are hinged to the sash at or in the vicinity of one end of a pair of opposed sash elements and to the frame at or in the vicinity of the middle of the corresponding frame elements. In most cases, this arrangement will, dependently on the dimensions of the window and its mounting level, enable the sash to be moved in the most expedient way.

BRIEF DESCRIPTION OF THE DRAWINGS

Further details and advantages of the window according to the invention will appear from the following explanation of an embodiment with reference to the accompanying substantially diagrammtical drawing in which.

DETAILED DESCRIPTION OF THE PREFERRED EMBODIMENTS

Figure 1:
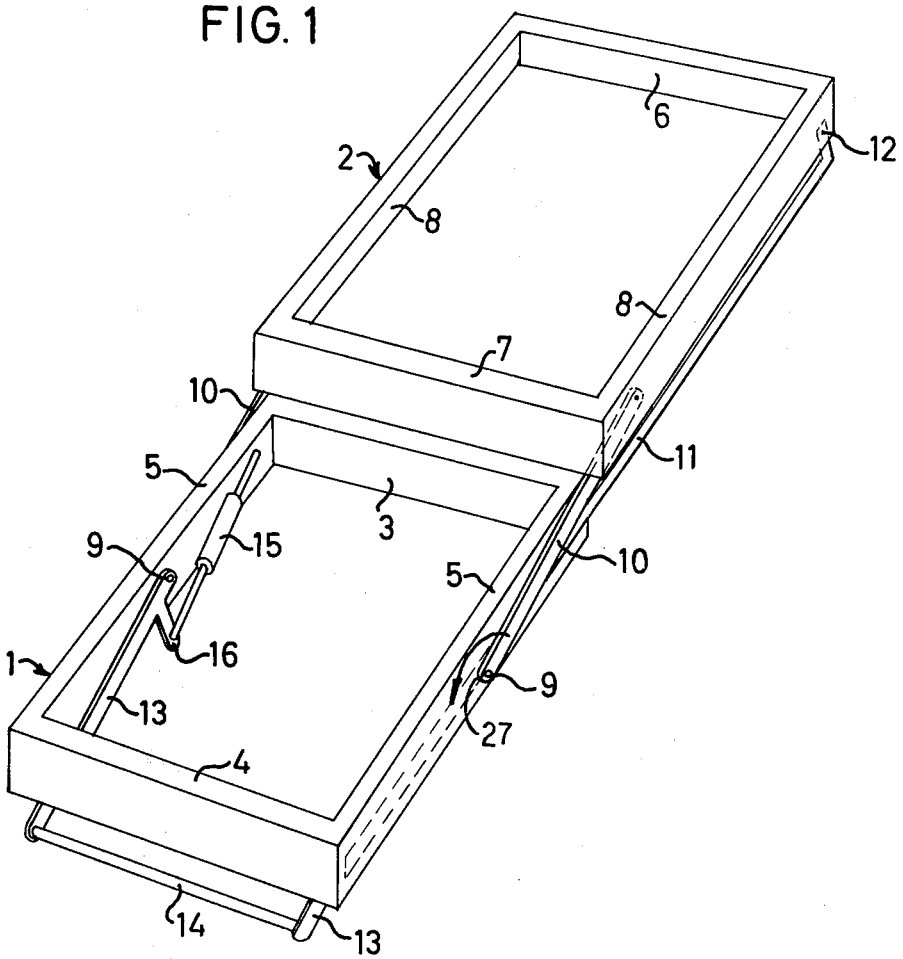
FIG. 1 shows a perspective view of the window, viewed from the outside and in its fully open position.

The drawing illustrates a window which is intended for being mounted in an inclined roof and comprises a frame 1 and a sash 2 which in FIG. 1 is shown in its fully open position and which may have one or more panes of glass or some other transparent or translucent material. The frame is in the conventional manner composed of a top element 3 and a bottom element 4 as well as two lateral elements 5, and the sash is composed of corresponding elements 6, 7 and 8. In FIG. 1 it is presupposed that the sash elements have an angular cross-section and thereby form a circumferential skirt which in the closed position encloses the frame 1 and thus projects some distance down along the latter, reckoned from its outside. If the sash consists of wood, it may, however, be more expedient to provide it with a separate jacket which forms the circumferential skirt and in addition can carry or secure the window pane.

In the lateral frame elements 5, there are in the zone at the middle of the latter accommodated a pair of pins 9, each of which is rigidly connected to a link 10 which furthermore is pivotally connected to the sash 2 in the vicinity of the lower corners of the latter which are thereby during the opening and closing of the window forced to follow a circular arc around the common axis of the pins 9. The sash 2 is additionally guided in relation to the frame 1 by means of slide rails 11 which are placed along the sides 5, 8 of the window and may be of a conventional type and are consequently not shown in detail. Each slide rail is here supposed to consist of at least three sections, viz. a lower section, which is secured to the lateral frame element 5, and an upper section, which by means of a pin 12 is hinged to the sash 2 near the top edge of the latter, as well as at least one intermediate section which forms a telescopic connection between the two former sections. It may, however, be sufficient with a single displaceable rail at either side of the window.

With a view to a convenient maneuvering of the window, that is to say the opening and closing of the sash 2, each of the links 10 is via the pin 9 rigidly connected to a maneuvering arm 13 located at the inside of the associated lateral frame element 5, and the free ends of these arms are interconnected by means of a grip rod 14. In the fully open position shown, the grip rod is located rather closely to the bottom element of the frame, so that neither this rod nor the maneuvering arms 13 limit the size of the frame aperture appreciably. Consequently, there is a free view through this frame aperture and a good possibility of emergency exit, for example in the case of fire. In the closed position of the window, the links 10 and thereby the maneuvering arms 13 are turned slightly less than 180° in the direction of the arrow designated by the reference numeral 27 in FIG. 1, and the grip rod 14 will then be substantially level with the top element 3 of the frame, in which position it does not either obstruct the view.

In the case of large and consequently heavy window sashes 2, it may be expedient to compensate for at any rate part of the weight of the sash during the whole or part of the opening and closing movement, to facilitate the opening and to effect a braking of the movement toward the closed position. Such a compensation can be obtained by the incorporation of suitable springs or compensators between the frame 1 and the sash 2 or the links 10 of the latter with associated maneuvering arms 13. In the drawing, this has been illustrated by a pressurized-gas cylinder 15 being inserted between one lateral frame element 5 and a projection 16 on the adjacent maneuvering arm 13. This pressurized-gas cylinder as well as the links 10 and the slide rails 11 may in the closed position of the sash be effectively protected against the outer air as, if it be desired, the skirt of the sash may be brought into tight engagement with the roof surface around the frame. If the frame 1 and the sash 2 consist of materials having a poor heat conductivity, the formation of cold conductors is also avoided, even if the links are of metal.

Figure 2:
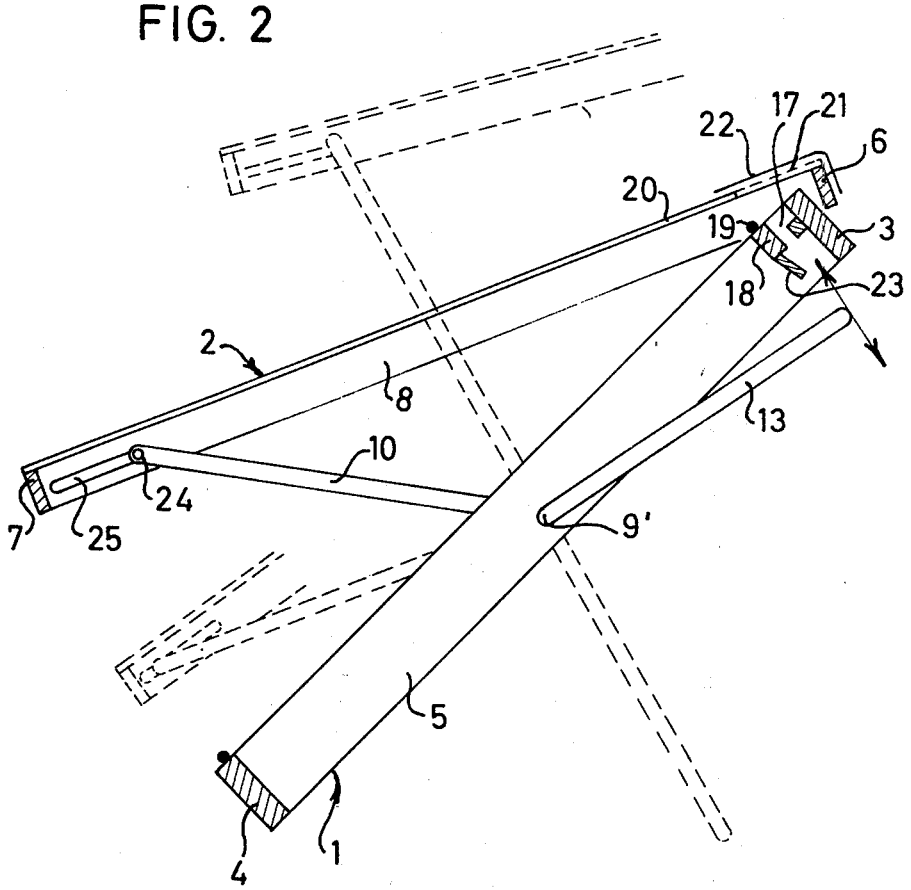
FIG. 2 shows a side elevation, partly in section, with the sash drawn in full lines in an intermediate position and indicated in a couple of other positions.

In the embodiment in FIG. 2, the same reference numerals as in FIG. 1 have been used for analogous components. For the sake of clearness, the slide rails and the hinge connections of the latter with the sash 2 have been omitted, and the pressurized-gas cylinder is not shown in FIG. 2, either. On the other hand, it has in this figure been indicated that the links 10 need not, as presupposed in FIG. 1, be rigidly connected to the maneuvering arm 13. Instead of the pin connection 9 there may thus between the said elements be inserted a ratchet coupling 9', now shown in detail, or a similar coupling mechanism which can be engaged and disengaged manually. By this means, it will for example become possible by an oscillating movement of the maneuvering arm 13, as indicated by the double arrow, to "pump" the sash 2 from its closed position into the intermediate position shown in full lines or possibly still further. Hereby the grip rod connected to the maneuvering arm may remain in the vicinity of the frame element 3.

Further, a ventilation slot 17 has been shown which is located between the frame element 3 and a cross-bar 18 with a packing 19, against which the pane 20 of the window abuts in the closed position. Above the upper edge 20 of the window pane, the sash 2 comprises a net or filter 21 which may be protected by an external cover 22. The ventilation slot 17 can be closed by means of a flap 23 which in a way not shown in detail can be operated by means of the grip rod connected to the arm 13. This grip rod may, for example, in the closed position of the sash, have a lost motion in relation to the sash and may during this motion carry along with it the flap 23 to the open position shown, after which the grip rod is released from the flap and is utilized for moving the sash.

In addition, FIG. 2 shows that the hinge connection between the link 10 and the sash 2 may be constituted by a pin 24 which is displaceable in a short slot 25 which is parallel to the plane of the sash. By this means, the hinge connection between frame and sash may remain stationary during the first part of the opening movement of the sash, viz. until the pin 24 engages the upper end of the slot.

It will be obvious that the invention is not limited to the embodiments shown in the drawing insofar as regards the general construction of the window. By way of example, the length of the links shown and the placing of the pivot connections of the latter to frame and sash may be varied within wide limits. In addition it should be pointed out that an arrangement like that explained above may also be used in connection with vertically mounted windows and irrespectively of the direction of movement of the sash during the opening of the window. In the embodiments shown, this movement is substantially performed as a displacement along the surface of the roof in an upward direction, but it might also be downwardly directed or laterally directed.

What is claimed is:

1. A window for installation in a roof of a building, comprising:

a rectangular frame, including a pair of lateral frame members, a bottom frame member, and a top frame member;

a sash, including corresponding lateral, top, and bottom sash members;

a pair of slide rails respectively extending displaceably along said lateral frame members and hingedly connected to said sash adjacent the top member thereof; and a pair of link arms having first ends respectively journaled to said frame at about the respective central regions of said lateral frame members and second ends journaled to said sash adjacent the bottom member thereof, said link arms at said first ends being interconnected through an internal maneuvering handle, said handle including a pair of lateral maneuvering arms connected to said link arms at said first ends, and a grip rod rigidly interconnecting said maneuvering arms and extending substantially perpendicular thereto at a point spaced from said first ends, displacement of said handle causing a corresponding displacement of the sash with respect to the fixed frame, said bottom member of the sash following a path, during the opening or closing motion of the sash, that is defined by the fixed length of the link arms, and said top of the sash moving laterally along a path defined by the slide rails, said slide rails being oriented in a plane parallel to and displaced from the plane defined by said link arms.

2. A window as claimed in claim 1, wherein said link at one end is journalled to said sash by means of a pin- and slot connection.

3. A window as claimed in claim 1, further comprising a sash weight compensator inserted between said sash and said link.

4. A window, primarily for installation in a roof of a building, comprising:

a frame, including a pair of lateral frame members, a bottom frame member, and a top frame member;

a sash, including lateral, top and bottom sash members corresponding to the lateral, top, and bottom frame members of said frame, said frame and said sash being structurally adapted to define a closed window position; and means movably connecting said sash to said frame and cooperating therewith to cause said sash to be removed from said frame to define an opened window position, said connecting means comprising:

a. a pair of slide rails respectively extending displaceably along said lateral frame members and hingedly connected to said sash near the top member thereof, b. a pair of link arms including first ends thereof respectively journaled to said frame at about the respective central regions of said lateral frames, and second ends journaled to said sash near the bottom member thereof, and c. an internal maneuvering handle interconnecting said first ends of said link arms, said handle including a pair of lateral maneuvering arms connected to said link arms at said first ends, and a grip rod rigidly interconnecting said maneuvering arms and extending substantially perpendicular thereto at points spaced from said first ends, displacement of said handle causing a corresponding displacement of the sash with respect to the fixed frame, said bottom member of the sash following a path, during the opening or closing motion of the sash, that is defined by the fixed length of the link arms, and said top of the sash moving laterally along a path defined by the slide rails, said slide rails being oriented in a plane parallel to and displaced from the plane defined by said link arms.

* * * * *